US011435162B2

(12) United States Patent
Heath et al.

(10) Patent No.: US 11,435,162 B2
(45) Date of Patent: Sep. 6, 2022

(54) MODULAR WEAPON SIGHT ASSEMBLY

(71) Applicant: EOTECH, LLC, Ann Arbor, MI (US)

(72) Inventors: Anthony Heath, Ypsilanti, MI (US); Deanna Kay McMillen, Protland, OR (US)

(73) Assignee: EOTech, LLC, Plymouth, MI (US)

( * ) Notice: Subject to any disclaimer, the term of this patent is extended or adjusted under 35 U.S.C. 154(b) by 0 days.

(21) Appl. No.: 17/380,435

(22) Filed: Jul. 20, 2021

(65) Prior Publication Data

US 2022/0065583 A1 Mar. 3, 2022

Related U.S. Application Data

(63) Continuation of application No. 16/690,512, filed on Nov. 21, 2019, now Pat. No. 11,098,980.

(51) Int. Cl.

| | |
|---|---|
| ***F41G 1/033*** | (2006.01) |
| ***F41G 11/00*** | (2006.01) |
| ***F41G 1/30*** | (2006.01) |

(52) U.S. Cl.

CPC ..... *F41G 1/033* (2013.01); *F41G 1/30* (2013.01); *F41G 11/001* (2013.01)

(58) Field of Classification Search

CPC ... F41G 1/003; F41G 1/30; F41G 1/16; F41G 1/17; F41G 1/26; F41G 1/32; F41G 1/34;

(Continued)

(56) References Cited

U.S. PATENT DOCUMENTS 3,994,597 A 11/1976 Calder et al.
4,191,471 A 3/1980 Courten (Continued)

FOREIGN PATENT DOCUMENTS

EP 2943736 B1 10/2017
ES 2672007 T3 6/2018

(Continued)

OTHER PUBLICATIONS

International Search Report for Application No. PCT/US2020/060714 dated Jun. 21, 2021; 2 pp.

(Continued)

*Primary Examiner* — Joshua E Freeman
(74) *Attorney, Agent, or Firm* — Bodman PLC

(57) ABSTRACT

Methods and systems are disclosed for a modular weapon sight assembly. A weapon sight may include a base, an optical bench, an adjuster assembly, and/or a housing. The base may be configured to be releasably secured to a weapon. The optical bench may include a plurality of optical elements attached to a unitary component carrier. A relative position of the plurality of optical elements may define an optical path of the weapon sight. The base, the optical bench, the adjuster assembly, and the housing may be configured as separate modules. For example, the optical path of the optical bench may remain constant during adjustment and/or replacement of the base, the adjuster assembly, and/or the housing. A change in position of the base, the adjuster assembly, and/or the housing may not alter the relative position of the plurality of optical elements with respect to one another.

17 Claims, 11 Drawing Sheets

(58) Field of Classification Search
CPC ... F41G 1/345; F41G 1/35; F41G 1/36; F41G 11/003
USPC ..... 42/135
See application file for complete search history.

(56) References Cited

U.S. PATENT DOCUMENTS

| | | | | |
|---|---|---|---|---|
| 4,592,654 | A | 6/1986 | Girault | |
| 4,940,324 | A | 7/1990 | Nichols | |
| 5,090,805 | A | 2/1992 | Stawarz | |
| 5,134,798 | A | 8/1992 | Lee | |
| 5,369,888 | A | 12/1994 | Kay | |
| 5,383,278 | A | 1/1995 | Kay | |
| 5,483,362 | A * | 1/1996 | Tai | F41G 1/30 359/1 |
| 5,508,843 | A | 4/1996 | Tomita | |
| 6,000,667 | A | 12/1999 | Isbell et al. | |
| 6,490,060 | B1 * | 12/2002 | Tai | G02B 5/32 359/15 |
| 7,145,703 | B2 | 12/2006 | Sieczka et al. | |
| 7,225,578 | B2 | 6/2007 | Tai | |
| 7,784,192 | B2 | 8/2010 | Jancic et al. | |
| 7,872,747 | B2 | 1/2011 | Gerlach | |
| 8,056,245 | B2 | 11/2011 | Cranton et al. | |
| 8,087,196 | B2 | 1/2012 | Jung et al. | |
| 8,156,679 | B1 | 4/2012 | Swan | |
| 8,186,093 | B1 | 5/2012 | Chung | |
| 8,240,075 | B1 | 8/2012 | Mullin | |
| 8,296,991 | B1 | 10/2012 | Chung | |
| 8,671,611 | B2 | 3/2014 | Ostergren et al. | |
| 9,057,584 | B2 | 6/2015 | Chung | |
| 9,500,442 | B2 | 11/2016 | Collin et al. | |
| 10,095,089 | B2 | 10/2018 | Po et al. | |
| 10,247,515 | B2 | 4/2019 | Collin | |
| 10,254,532 | B2 | 4/2019 | Collin | |
| 10,267,597 | B2 | 4/2019 | Olmstead et al. | |
| 10,345,077 | B1 | 7/2019 | Loebig et al. | |
| 10,345,587 | B1 | 7/2019 | Loebig et al. | |
| 10,591,249 | B2 | 3/2020 | Campbell | |
| 10,704,862 | B2 | 7/2020 | Chung | |
| 10,801,813 | B2 | 10/2020 | Moseman et al. | |
| 2003/0074824 | A1 | 4/2003 | Arachequesne | |
| 2006/0265930 | A1 | 11/2006 | Woodbury | |
| 2008/0020355 | A1 | 1/2008 | Young | |
| 2008/0216379 | A1 | 9/2008 | Javorsky | |
| 2009/0116231 | A1 | 5/2009 | Miller | |
| 2009/0193705 | A1 | 8/2009 | LoRocco | |
| 2010/0162611 | A1 | 7/2010 | Samson et al. | |
| 2011/0228366 | A1 | 9/2011 | Liu | |
| 2013/0008072 | A1 | 1/2013 | Chung | |
| 2014/0237884 | A1 | 8/2014 | Koesler | |
| 2014/0305022 | A1 | 10/2014 | Chung | |
| 2014/0317988 | A1 | 10/2014 | Battis et al. | |
| 2015/0198415 | A1 | 7/2015 | Campean | |
| 2015/0267997 | A1 * | 9/2015 | Collin | H01S 5/06804 359/1 |
| 2016/0003996 | A1 | 1/2016 | Dehmlow et al. | |
| 2016/0033232 | A1 | 2/2016 | Cheng | |
| 2016/0102943 | A1 * | 4/2016 | Teetzel | B27B 5/36 42/113 |
| 2016/0161735 | A1 | 6/2016 | Ambruster | |
| 2016/0313089 | A1 * | 10/2016 | Collin | F41G 1/30 |
| 2016/0327365 | A1 | 11/2016 | Collin et al. | |
| 2016/0377377 | A1 | 12/2016 | Collin | |
| 2016/0377378 | A1 * | 12/2016 | Collin | F41G 1/30 42/113 |
| 2017/0205194 | A1 | 7/2017 | Teetzel et al. | |
| 2018/0292168 | A1 * | 10/2018 | Borrico | F41G 1/30 |
| 2019/0072702 | A1 | 3/2019 | Voloschenko et al. | |
| 2019/0145733 | A1 | 5/2019 | Chung | |
| 2019/0277600 | A1 | 9/2019 | Larsson | |
| 2019/0346235 | A1 | 11/2019 | Sidelkovsky | |
| 2020/0011640 | A1 | 1/2020 | Moseman et al. | |
| 2020/0141700 | A1 | 5/2020 | Moseman et al. | |
| 2020/0240748 | A1 * | 7/2020 | Connolly | F41G 1/387 |
| 2020/0272044 | A1 | 8/2020 | Walker | |
| 2021/0156645 | A1 | 5/2021 | Heath | |
| 2021/0156646 | A1 | 5/2021 | Schulte et al. | |
| 2021/0157086 | A1 | 5/2021 | Heath et al. | |
| 2021/0157119 | A1 | 5/2021 | Heath et al. | |
| 2021/0157267 | A1 | 7/2021 | Heath | |

FOREIGN PATENT DOCUMENTS

| | | | |
|---|---|---|---|
| JP | 4019995 | B2 | 12/2007 |
| JP | 2008090257 | A | 4/2008 |
| KR | 101375457 | B1 | 3/2014 |
| RU | 2582900 | C1 | 4/2016 |
| WO | 1995031740 | A1 | 11/1995 |
| WO | WO2019/068165 | * | 10/2017 |
| WO | 2020250758 | A1 | 12/2020 |
| WO | 2021141669 | A1 | 7/2021 |
| WO | 2021141670 | A2 | 7/2021 |
| WO | 2021141671 | A1 | 7/2021 |

OTHER PUBLICATIONS

International Search Report for Application No. PCT/US2020/060719 dated Aug. 20, 2021; 2 pp.
International Search Report for Application No. PCT/US2020/060695 dated May 21, 2021; 2 pp.
International Search Report for Application No. PCT/US2020/060707 dated Sep. 24, 2021; 2 pp.

* cited by examiner

100

100

300

500

500

MODULAR WEAPON SIGHT ASSEMBLY

CROSS-REFERENCE TO RELATED APPLICATION

This application is a continuation of U.S. Non-provisional application Ser. No. 16/690,512, filed Nov. 21, 2019, which is hereby incorporated by reference in its entirety.

BACKGROUND

Identifying and focusing on an object located at a distance may be facilitated by use of a sight. A sight may be employed, for example, with small arms such as bows, rifles, shotguns, and handguns, etc., and large arms such as mounted machine guns, grenade launchers, etc., and may assist an operator to locate and maintain focus on a target.

Sights have been developed in many different forms and utilizing various features. For example, sights have been developed that present the operator with a hologram which may assist the operator with locating and focusing on an object.

SUMMARY

Methods and systems are disclosed for a modular weapon sight assembly. A weapon sight may include a base, an optical bench, an adjuster assembly, and/or a housing. The base may be configured to be releasably secured to a weapon. The base may be associated with a first datum. The optical bench may be configured to be attached to the base. The optical bench may be associated with a second datum. The optical bench may include a plurality of optical elements attached to a unitary component carrier. A relative position of the plurality of optical elements may define an optical path of the weapon sight. The optical path may be structurally isolated from the base, the adjuster assembly, and the housing. The plurality of optical elements may include a laser diode, a mirror, a collimating optic, and/or a holographic grating. The adjuster assembly may be configured to be attached to the base. The adjuster assembly may be associated with a third datum. The housing may be configured to enclose the optical bench within the weapon sight. The housing may be associated with a fourth datum. The first datum may be associated with a first reference system that may be used to fabricate and assemble the base. The second datum may be associated with a second reference system that may be used to fabricate and assemble the adjuster assembly. The third datum may be associated with a third reference system that may be used to fabricate and assemble the optical bench. The fourth reference system may be associated with a fourth reference system that may be used to fabricate and assemble the housing.

The modular weapon sight assembly may be configured such that the individual sub-systems or associated reference systems (e.g., the base, the optical bench, the adjuster assembly, and/or the housing) are relatively independent from each other such that environmental stresses in one sub-system/reference system do not easily propagate into the other sub-systems/reference systems.

For example, the base, the optical bench, the adjuster assembly, and the housing may be configured as separate modules. By configuring the sub-systems as separate modules, the optical path of the optical bench may remain constant during adjustment and/or replacement of the base, the adjuster assembly, and/or the housing. The housing may be configured such that the housing is moveable without affecting a relative position of the plurality of optical elements with respect to one another. A change in position of the adjuster assembly may not alter the relative position of the plurality of optical elements with respect to one another. The base may be configured to be adjustable such that a change in position of the base does not alter the relative position of the plurality of optical elements with respect to one another. By allowing the optical path of the optical subsystem to remain constant during changes or modifications to other modules, the holographic sight may operate more consistently and/or be less vulnerable to environmental stresses, as the optical subsystem may be the system most prone to cause errors in the performance of the holographic sight due to impacts/shocks and/or changes in environmental factors (e.g., temperature changes).

The adjuster assembly may include an adjuster support bridge, a first adjuster, and a second adjuster. The adjuster support bridge may be configured to be attached to the base. The first adjuster may be configured to horizontally adjust a position of a holographic reticle. The second adjuster may be configured to vertically adjust the position of the holographic reticle. The first adjuster and the second adjuster may be supported by the adjuster bridge. The base may include a first adjuster aperture that receives a portion of the first adjuster. The housing may include a second adjuster aperture that receives a portion of the second adjuster. The housing may include a front window and a rear window.

DETAILED DESCRIPTION

Figure 1:
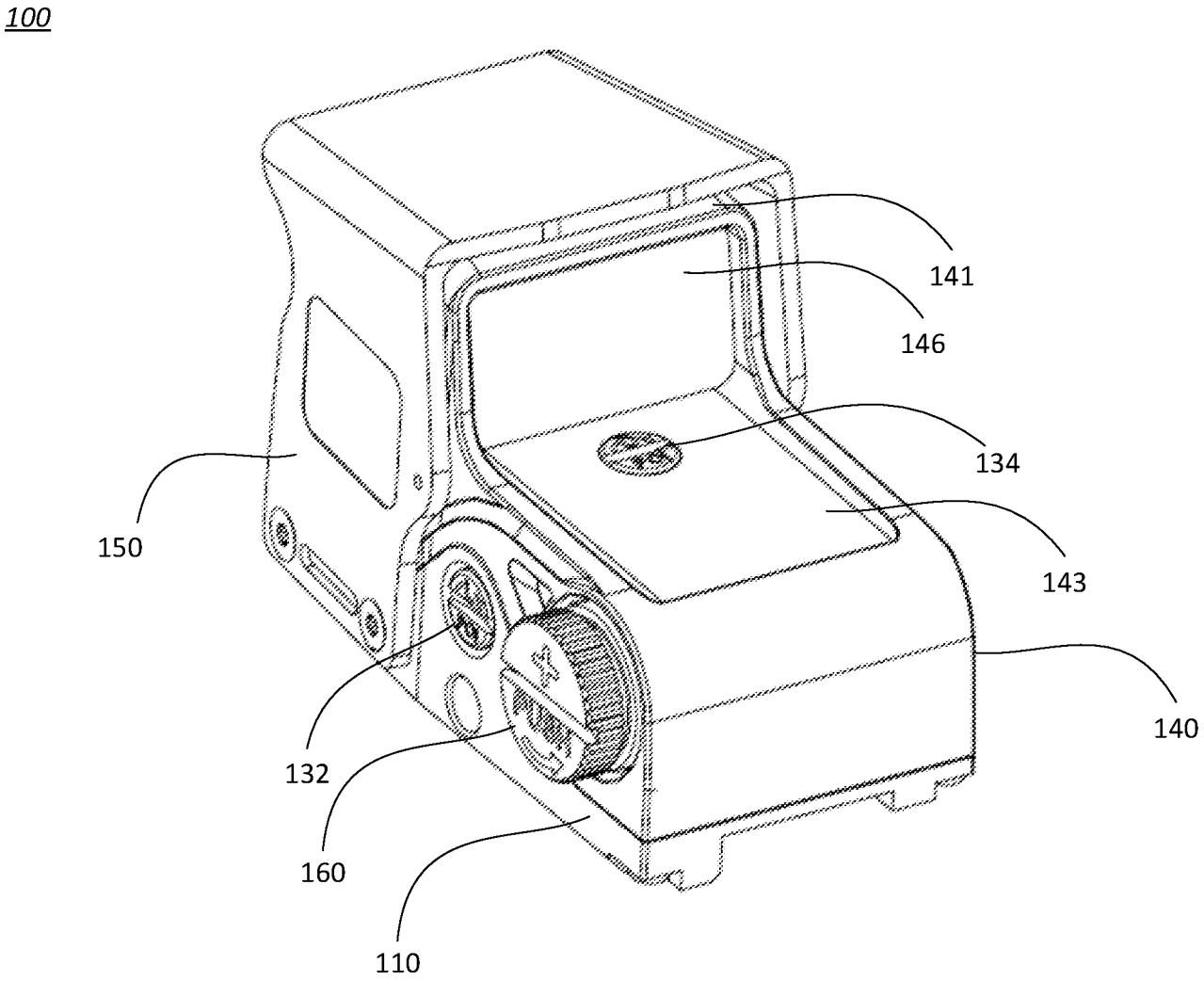
FIG. 1 is a front perspective view of an example modular weapon sight.
Figure 2:
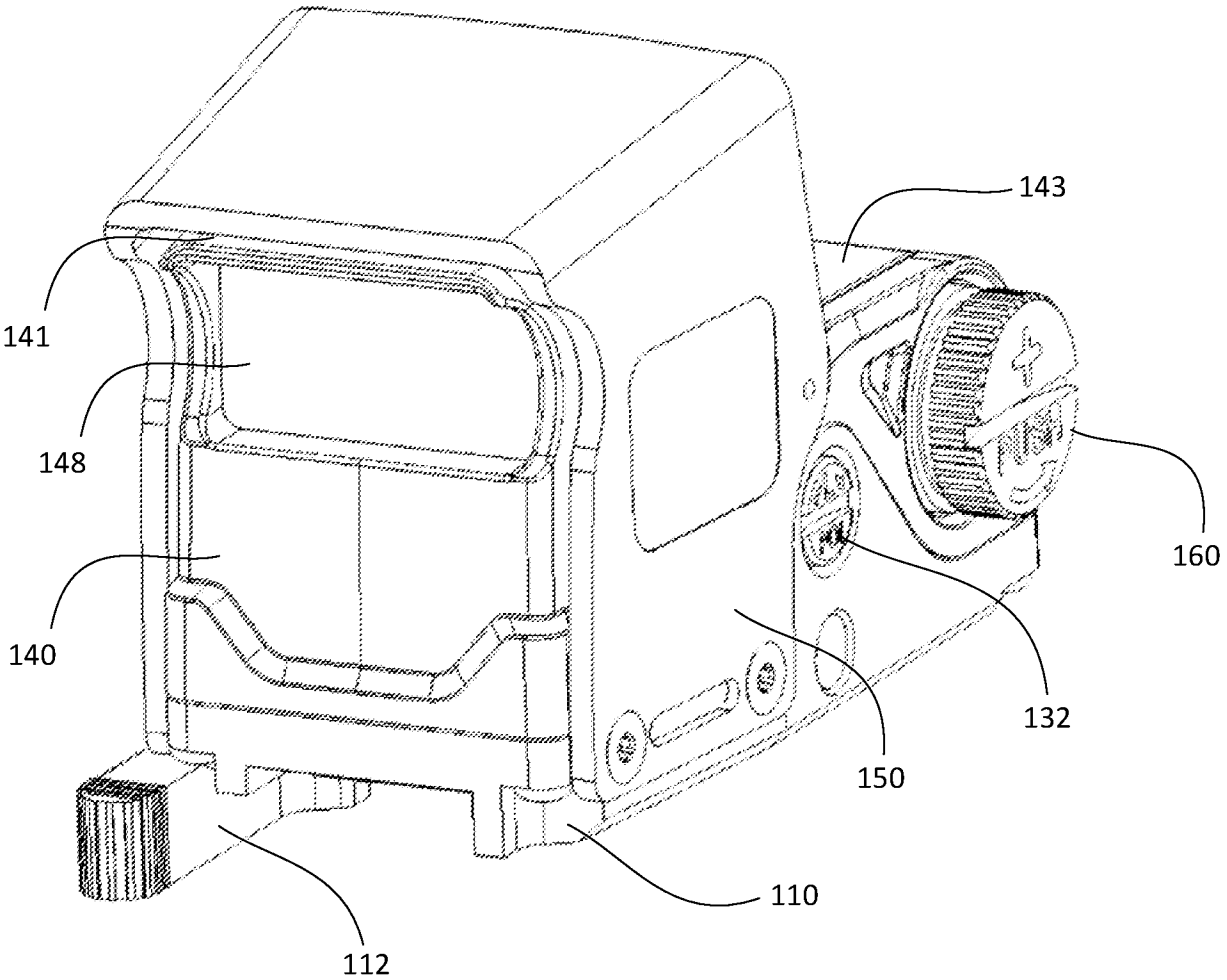
FIG. 2 is a rear perspective view of the example modular weapon sight shown in FIG. 1.
Figure 3:
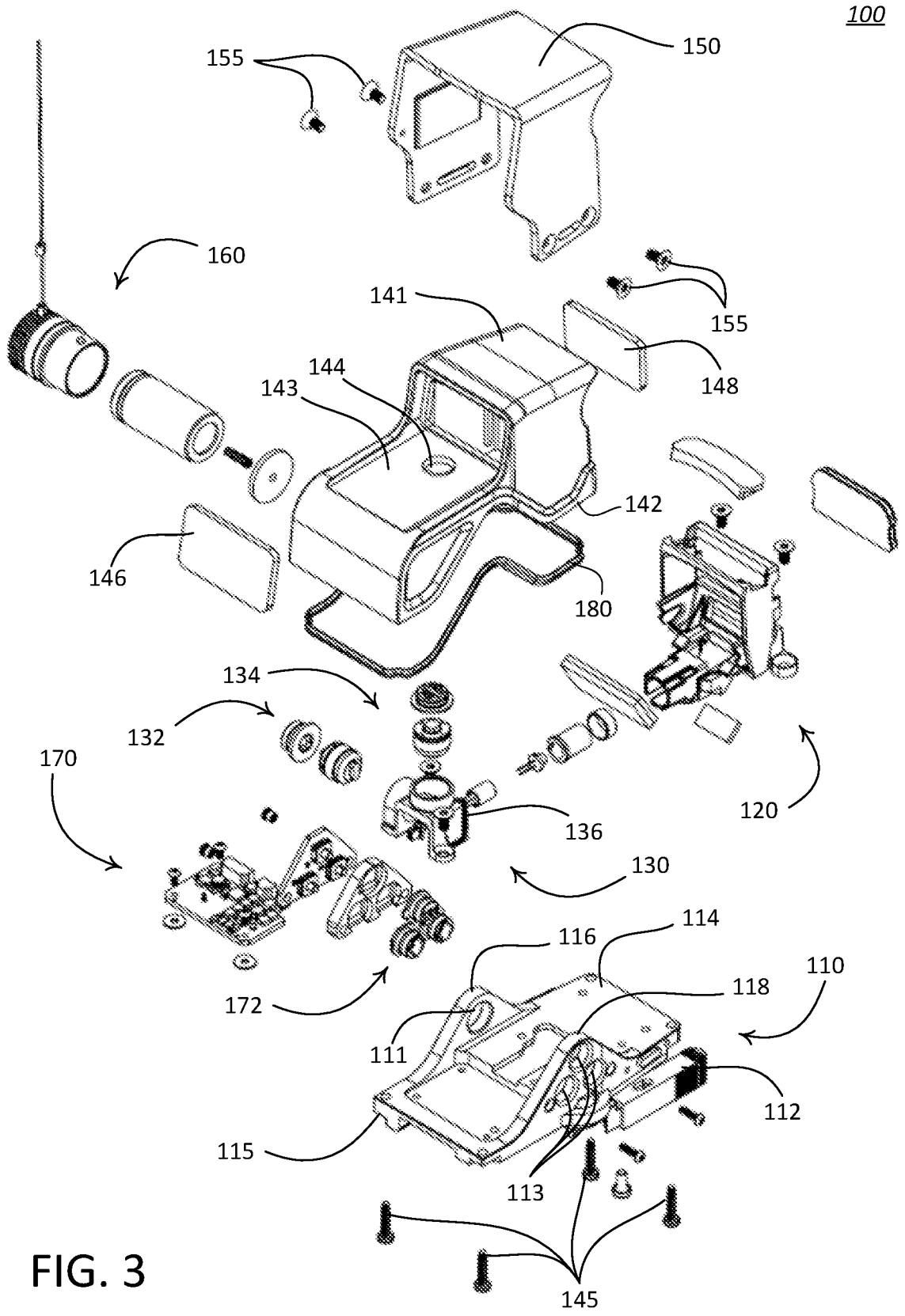
FIG. 3 is a partially exploded view of the example modular weapon sight shown in FIG. 1.
Figure 4:
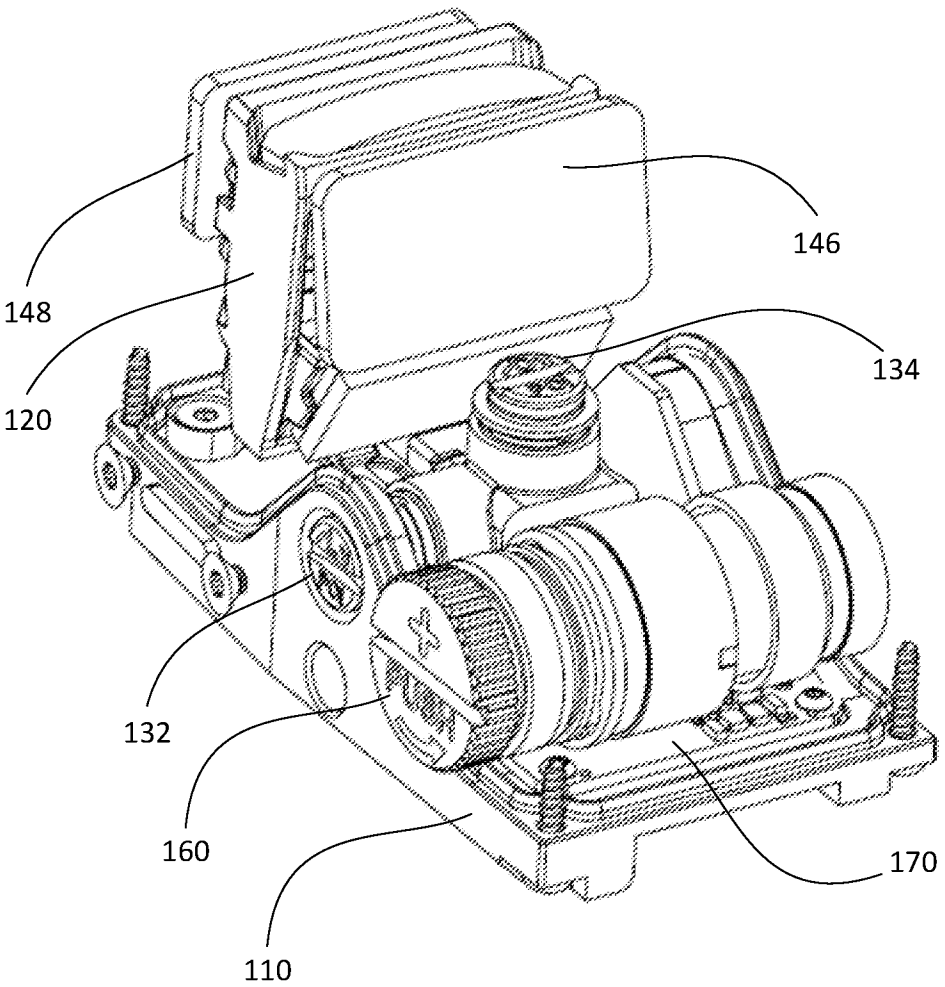
FIG. 4 is a perspective view of the example modular weapon sight shown in FIG. 1 with portions of the hood and housing removed.
Figure 5B:
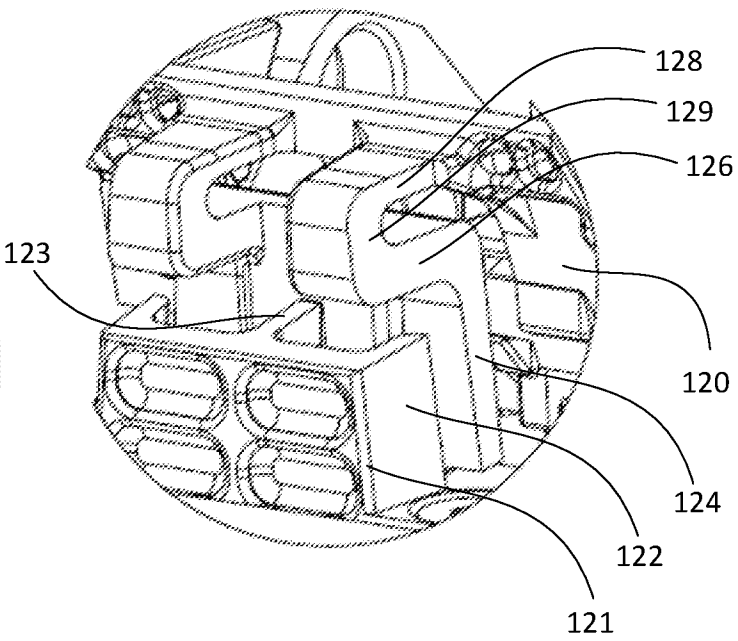
FIG. 5B is a detailed view of a portion of the example optical bench shown in FIG. 5A.
Figure 5A:
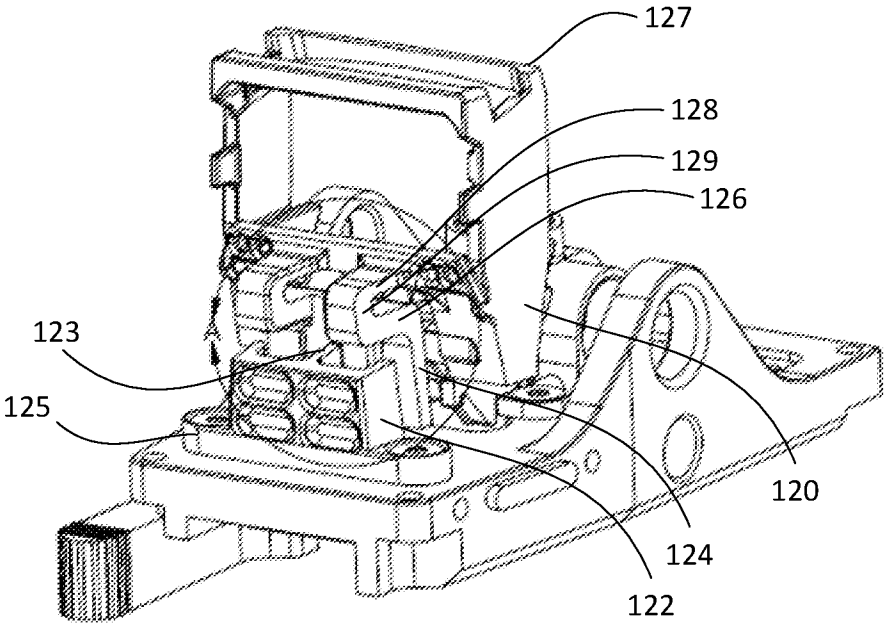
FIG. 5A is a perspective view of an example optical bench attached to an example mount.

Methods and systems are disclosed for a modular weapon sight. Holographic sights may employ a series of optical components to generate a hologram for presentation to the operator. For example, a holographic sight may employ a laser diode that generates a light beam, a mirror that deflects the light beam, a collimating optic that receives the deflected light beam and reflects collimated light, a grating that receives the collimated light and reflects light toward an image hologram that has been recorded with an image and which displays the image to the operator of the sight. The collimating optic may be a collimating reflector, a refracting collimator, and/or the like. Operation of the holographic sight requires that the optical components be in the intended relative positions, including distance and orientation, relative to each other. Even small variances from the intended position of even one of the optical components may negatively impact the generation of a hologram for use by the operator of the sight.

Holographic sights may position optical components relative to each other by affixing them to structures in a holographic sight. For example, optical components such as, for example, the collimating optic and the hologram image may be affixed to an interior of a holographic sight housing. The mirror may be positioned on a podium extending from a mount to which the sight housing is attached. The grating may be affixed to a moveable plate configured to rotate relative to the sight housing. Because the optical components are attached to different components which themselves may be moveable relative to each other, it may be difficult to place the optical components in their intended positions even in a controlled manufacturing environment. Furthermore, movement of any of the structures to which the optical components are attached may move the optical components from their intended positions causing degradation in the creation of the hologram. For example, in a scenario the housing to which the collimating optic and hologram are attached receives an external impact, the housing and the optical components attached to it may be moved by the external blow from their intended positions which may degrade the quality of the hologram.

The holographic sight disclosed herein employs a modular assembly. The modular weapon sight may be configured as separate modules such that an optical path of the weapon sight remains constant during assembly, adjustment, operation, and replacement of one or more modules. In other words, sub-systems are defined within the weapon sight to perform certain functions, and to a large extent each subsystem is designed to be mechanically and structurally isolated from the other sub-systems. The optical subsystem may be an example of such a subsystem, and by isolating the optical subsystem from other subsystems in the sight, modifications or environmental factors affecting the weapon sight (e.g., one or more sub-systems) may not easily propagate to the optical components, reducing the risk of performance degradation of the holographic system.

The modular assembly may be mechanically stable, and the optical components received therein may be maintained in their intended relative positions. The modular assembly may include a unitary optical component carrier (e.g., such as the optical bench 120 shown in FIGS. 3, 4, 5A and 5B, and/or the optical bench 500 shown in FIGS. 10 and 11). The unitary optical component carrier may comprise a body with a plurality of receptacles that are configured to receive optical components therein and to maintain the relative position of the optical components. The modular weapon sight assembly may enable interchangeable hoods, housings, electronics modules, and/or optical element(s). The modular weapon sight assembly may provide temperature immunity for azimuth and/or elevation functionality. The modular weapon sight assembly may enable faster assembly and/or increase repairability. The modular weapon sight assembly may reduce a number of physical connections between the components of the weapon sight.

FIGS. 1-5B illustrate an example weapon sight 100. The weapon sight 100 may be a modular weapon sight. The weapon sight 100 may include a base 110, an optical bench 120, an adjuster assembly 130, a housing 140, and/or a hood 150. The base 110, the optical bench 120, the adjuster assembly 130, the housing 140, and the hood 150 may be configured as separate modules. For example, the base 110 may be referred to as a base module; the optical bench 120 may be referred to as an optical chassis, optical chassis module, and/or optical bench module; the adjuster assembly 130 may be referred to as an adjuster assembly module; the housing 140 may be referred to as a housing module; and the hood 150 may be referred to as a hood module. The base 110 may be associated with a first datum. The optical bench 120 may be associated with a second datum. The adjuster assembly 130 may be associated with a third datum. The housing 140 may be associated with a fourth datum. Each of the first, second, third, and fourth datums may be reference points, surfaces, or axes that are used for dimensioning and/or tolerancing the respective module. The first, second, third, and fourth datums may include a set of parameters that define a position of an origin, a scale, and/or an orientation of a corresponding reference and/or coordinate system. Because each of the modules is associated with its own datum, the relative position of the components of each of the modules remains substantially constant when repairing and/or replacing one or more modules.

The first datum may define a first reference point, surface, or axis that is used to dimension and/or tolerance the base 110 (e.g., one or more components of the base module). The first datum may be associated with a first reference system. The first reference system may be a spatial reference system and/or a coordinate reference system used to locate one or more components or features of the base 110. For example, the components and features of the base 110 may be assembled and/or fabricated in relation to the first datum using the first reference system.

The second datum may define a second reference point, surface, or axis that is used to dimension and/or tolerance the optical bench 120 (e.g., one or more components of the optical bench 120). The second datum may be associated with a second reference system. The second reference system may be a spatial reference system and/or a coordinate reference system used to locate one or more components and/or features of the optical bench 120. For example, the components and features of the optical bench 120 may be assembled and/or fabricated in relation to the second datum using the second reference system. One or more optical components of the optical bench 120 may be located, dimensioned, and/or toleranced in relation to the second datum using the second reference system.

The third datum may define a third reference point, surface, or axis that is used to dimension and/or tolerance the adjuster assembly 130 (e.g., one or more components of the adjuster assembly 130). The third datum may be associated with a third reference system. The third reference system may be a spatial reference system and/or a coordinate reference system used to locate one or more components and/or features of the adjuster assembly 130. For example, the components and features of the adjuster assembly 130 may be assembled and/or fabricated in relation to the third datum using the third reference system.

The fourth datum may define a fourth reference point, surface, or axis that is used to dimension and/or tolerance the housing 140 (e.g., one or more components of the housing 140). The fourth reference system may be associated with a fourth reference system. The fourth reference system may be a spatial reference system and/or a coordinate reference system used to locate one or more components and/or features of the housing 140. For example, the components and features of the housing 140 may be assembled and/or fabricated in relation to the fourth datum using the fourth reference system. The first, second, third, and fourth reference systems may be independent from one another.

The base 110 may be configured to attach to a weapon (e.g., such as a hand gun, a rifle, a shotgun, a bow, etc.). For example, the base 110 may be configured to attach (e.g., removably attach) to an upper surface (e.g., a rail) of the weapon. The base 110 may include a lever arm 112 that is mounted (e.g., pivotally mounted) to the base 110. The lever arm 112 may be configured to be operated between an open position and a closed position such that the base 110 is configured to be removably attached to the weapon. For example, the lever arm 112 may be configured to engage a complementary feature on the upper surface of the weapon. The base 110 may define an upper surface 114. The optical bench 120 and the adjuster assembly 130 may be secured to the upper surface 114 of the base 110.

The base 110 may define a first extension 116 and a second extension 118. The first extension 116 and the second extension 118 may be on opposed sides of the base 110. The first extension 116 may include a first aperture 111. The first aperture 111 may be configured to receive a portion of the adjuster assembly 130. For example, the portion of the adjuster assembly 130 may be accessible via the first aperture 111. The second extension 118 may include a plurality of second apertures 113. The plurality of second apertures 113 may be configured to receive respective buttons 172 of an electronics module 170. For example, the buttons 172 may be accessible via the plurality of second apertures 113.

The weapon sight 100 may include a battery module 160. The battery module 160 may be configured to store a battery (not shown) that is configured to power a laser (e.g., such as laser diode 534 shown in FIGS. 10-11).

The weapon sight 100 may be a holographic weapon sight. The optical bench 120 may include a plurality of optical elements. The optical bench 120 (e.g., the plurality of optical elements) may be configured to project a holographic reticle. For example, the plurality of optical elements may include a laser diode, a mirror, a collimator, a grating, and/or a hologram plate. The optical bench 120 (e.g., the plurality of optical elements) may define an optical path. For example, a relative position of the plurality of optical elements may define the optical path. The optical path may remain constant during assembly of the weapon sight, for example, mounting of the optical bench 120 to the base 110. The optical path may remain constant during adjustment or replacement of other modules (e.g., such as the base 110, the optical bench 120, the adjuster assembly 130, and/or the housing 140). When the optical path of the weapon sight 100 remains constant, the relative position of the plurality of optical elements with respect to one another is not altered. For example, a change in position of one or more modules (e.g., the housing 140, the adjuster assembly 130, and/or the base 110) does not alter the relative position of the plurality of optical elements with respect to one another.

The optical bench 120 may include an optical bench base 125, a support member 121, and a unitary optical component carrier 127. The support member 121 may be integrally formed with the optical bench base 125 and may extend upward from the optical bench base 125. The unitary optical component carrier 127 may be integrally formed with the support member 121. The optical bench base 125 may be secured to the base 110. For example, the optical bench base 125 may be secured to the base 110 using screws that extend through openings in the optical bench base 125 and into corresponding receptacles in the base 110. The support member 121 and/or the unitary optical component carrier 127 may be suspended relative to the base 110 by the optical bench base 125.

The optical bench 120 may include one or more portions that are flexible (e.g., compliant) such that the unitary optical component carrier 127 may be moveable in a horizontal and/or a vertical direction relative to the optical bench base 125 and/or the base 110. The one or more flexible portions of the optical bench 120 may include a flexible member 123, a first horizontal member 126, a second horizontal member 128, and/or a joint member 129. The one or more flexible portions of the optical bench 120 may be compliant so as to allow for adjustment of the position of the unitary optical component carrier 127 relative to the optical bench base 125 and/or base 110 and thereby allow for adjusting a position of a hologram in a viewing area of the weapon sight 100. For example, the flexible member 123 may be configured to flex (e.g., twist and/or rotate) to enable horizontal movement (e.g., adjustment) of the unitary optical component carrier 127. The joint member 129 may flex to enable vertical movement (e.g., adjustment) of the unitary optical component carrier 127. The optical bench 120 may include one or more portions that are non-compliant (e.g., inflexible). The one or more non-compliant portions of the optical bench 120 may include the support member 121, a first wall 122, and a second wall 124.

The adjuster assembly 130 may be configured to adjust a positioning of the optical bench 120. For example, the adjuster assembly 130 may include a first adjuster 132 and a second adjuster 134. The first adjuster 132 may be configured to horizontally adjust a position of a holographic reticle. For example, rotation of the first adjuster 132 may result in a horizontal adjustment of the holographic reticle. The second adjuster 134 may be configured to vertically adjust the position of the holographic reticle. For example, rotation of the second adjuster 134 may result in a vertical adjustment of the holographic reticle. The first adjuster 132 may be accessible (e.g., to rotate) through the base 110. The second adjuster 134 may be accessible (e.g., to rotate) through the housing 140.

A distal portion 131 of the first adjuster 132 may abut the optical bench 120. A distal portion 133 of the second adjuster 134 may abut the optical bench 120. The distal portion 131 of the first adjuster 132 may be configured to move a portion of the optical bench 120, for example, without altering a relative position of the plurality of optical elements with respect to one another. Stated differently, operation of the first adjuster 132 may adjust a position of the holographic reticle without affecting the optical path of the optical bench 120.

The housing 140 may be configured to enclose the optical bench 120, the adjuster assembly 130, the battery module 160, and/or an electronics module 170. The electronics module 170 may be part of the base 110. The housing 140 may define an upper portion 141 and a lower portion 143. The lower portion 143 may be configured to enclose the adjuster assembly 130, the battery module 160, the electronics module 170, and a lower portion of the optical bench 120. The upper portion 141 may be configured to enclose an upper portion of the optical bench 120. The housing 140 (e.g., the lower portion 143) may define a first aperture (e.g., such as aperture 330 shown in FIG. 7) and a second aperture 144. The first aperture may be configured to receive a portion of the battery module 160. The second aperture 144 may be configured to receive a portion of the second adjuster 134. The housing 140 may define an upper portion 141 and a lower portion 143.

The housing 140 (e.g., the upper portion 141) may define a front window 146 and a rear window 148. The front window 146 may represent the target-side window of the weapon sight 100. The rear window 148 may represent the operator-side window of the weapon sight 100. For example, a user of the weapon sight 100 may look through the rear window 148 and then through the front window 146 when using the weapon sight 100. A hologram of the weapon sight 100 may appear to be projected through the front window 146 of the weapon sight 100. The housing 140 may define the viewing area of the weapon sight 100. For example, the front window 146 and the rear window 148 may define the viewing area of the weapon sight. Stated differently, respective sizes of the front window 146 and the rear window 148 may define the viewing area of the weapon sight.

The housing 140 may be secured to the base 110. For example, the housing 140 may be secured to the base 110 using fasteners (e.g., such as fasteners 145). The base 110 may be configured to receive the fasteners 145. Respective heads of the fasteners 145 may abut a lower surface 115 of the base 110 when the fasteners 145 are received by the base 110.

When the housing is secured to the base, a lower surface 142 of the housing 140 may be configured to create a seal with the base 110 (e.g., the upper surface 114, the first extension 116, and the second extension 118). The lower surface 142 may compress a gasket 180 between the housing 140 and the base 110, for example, to prevent dirt and/or water from penetrating into the weapon sight 100. The gasket 180 may be a flexible ring composed of a compressible material (e.g., rubber, polytetrafluoroethylene (PTFE), nitrile, neoprene, silicone, fluorocarbon, etc.)

The hood 150 may be configured to protect the housing 140 (e.g., the upper portion 141 of the housing 140). For example, the hood 150 may be secured to the base 110. When the hood 150 is secured to the base 110, the hood 150 may surround the upper portion 141 of the housing 140.

Figure 6:
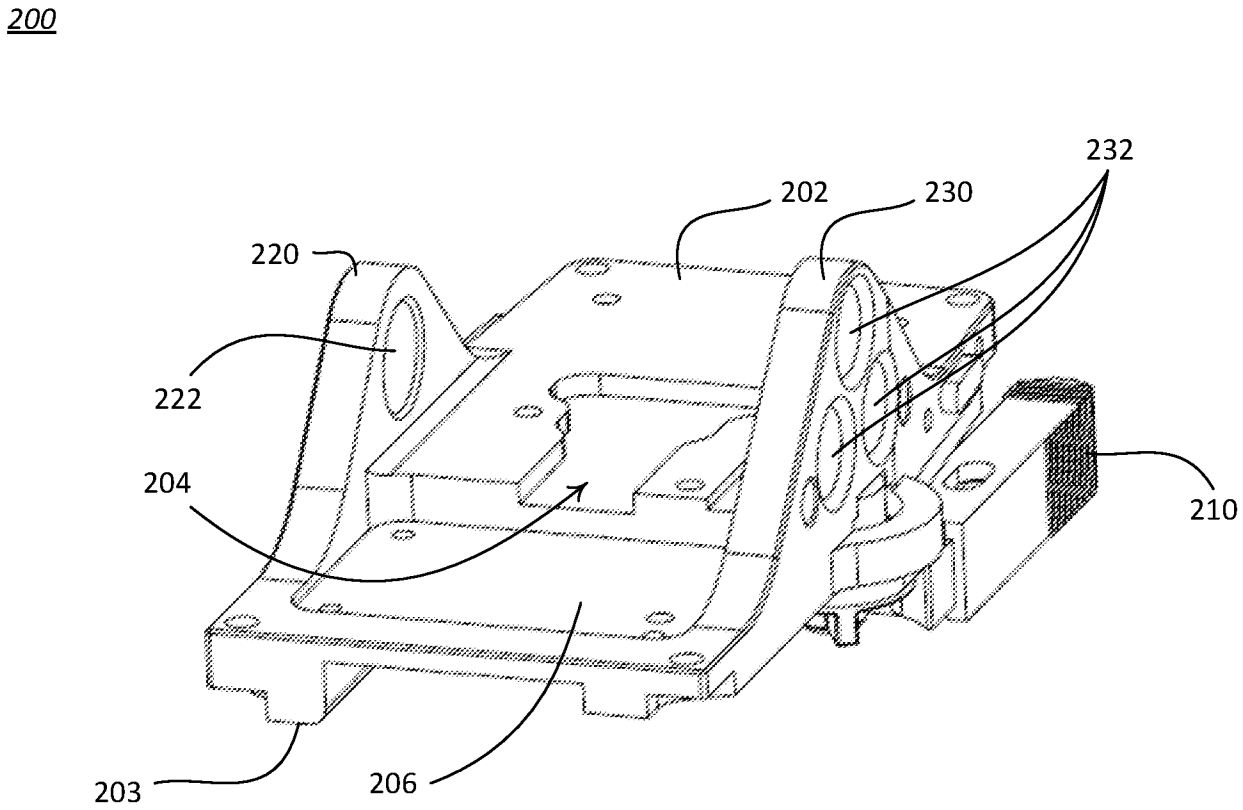
FIG. 6 is a perspective view of an example weapon sight mount.

FIG. 6 depicts an example base module 200 for a weapon sight (e.g., such as weapon sight 100 shown in FIGS. 1-5B). The base module 200 may be associated with a base module datum. The base module datum may define a base module reference point, surface, or axis that is used to dimension and/or tolerance the base module 200 (e.g., one or more components of the base module 200). The base module datum may be associated with a first reference system. The first reference system may be a spatial reference system and/or a coordinate reference system used to locate one or more components or features of the base module 200. The components and features of the base module 200 may be assembled and/or fabricated in relation to the base module datum using the first reference system. An origin of the first reference system may be defined by the base module datum.

The base module 200 (e.g., such as base 110 shown in FIGS. 1-5B) may be configured to attach to a weapon (e.g., such as a hand gun, a rifle, a shotgun, a bow, etc.). For example, the base module 200 may be configured to attach (e.g., removably attach) to an upper surface (e.g., a rail) of the weapon. The base module 200 may define a lower surface 203 that is configured to abut the upper surface of the weapon. The base module 200 may include a lever arm 210 that is mounted (e.g., pivotally mounted) to the base module 200. The lever arm 210 may be configured to be operated (e.g., pivoted) between an open position and a closed position such that the base module 200 is configured to be removably attached to the weapon. For example, the lever arm 210 may be configured to engage a complementary feature on the upper surface of the weapon.

The base module 200 may define an upper surface 202. The upper surface 202 may define a cavity 204. The cavity 204 may be configured to receive a portion of the weapon sight. For example, the cavity 204 may be configured to receive a portion of an optical bench (e.g., such as a portion of laser diode 534 shown in FIGS. 10 and 11). The cavity 204 may be configured to reduce an overall height of the weapon sight. The upper surface 202 may define an electronics module pad 206. The electronics module pad 206 may be configured to receive an electronics module of the weapon sight (e.g., such as electronics module 170 shown in FIG. 3). The electronics module pad 206 may be closer to the than the rest of the upper surface 202.

The base module 200 may define a first extension 220 and a second extension 230. The first extension 220 and the second extension 230 may be on opposed sides of the base module 200. The first extension 220 may include a first aperture 222. The first aperture 222 may be configured to receive a portion of an adjuster assembly (e.g., such as the adjuster assembly 130 shown in FIGS. 1-5B). For example, the portion of the adjuster assembly may be accessible via the first aperture 222. The second extension 230 may include a plurality of second apertures 232. The plurality of second apertures 232 may be configured to receive respective buttons of the electronics module. For example, the buttons may be accessible via the plurality of second apertures 232.

Figure 7:
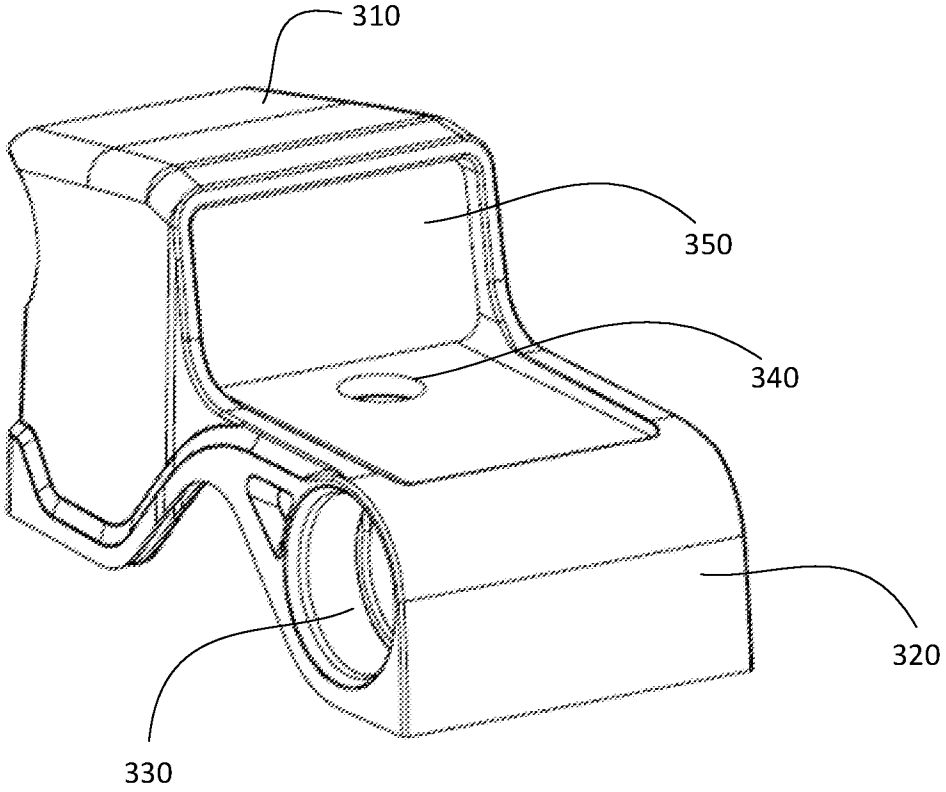
FIG. 7 is a perspective view of an example weapon sight housing.

FIG. 7 depicts an example housing module 300 for a weapon sight (e.g., such as weapon sight 100 shown in FIGS. 1-5B). The housing module 300 may be associated with a housing module datum. The housing module datum may define a housing module reference point, surface, or axis that is used to dimension and/or tolerance the housing module 300 (e.g., one or more components of the housing module 300). The housing module datum may be associated with a second reference system. The second reference system may be a spatial reference system and/or a coordinate reference system used to locate one or more components or features of the housing module 300. The components and features of the housing module 300 may be assembled and/or fabricated in relation to the housing module datum using the second reference system. An origin of the second reference system may be defined by the housing module datum.

The housing module 300 may be configured to enclose the optical elements of the weapon sight. The housing module 300 may define an upper portion 310 and a lower portion 320. The lower portion 320 may be configured to enclose an adjuster assembly (e.g., such as adjuster assembly 130 shown in FIGS. 1-5B), a battery module (e.g., such as the battery module 160 shown in FIGS. 1-5B, an electronics module (e.g., the electronics module 170 shown in FIGS. 1-5B), and a lower portion of an optical bench (e.g., the optical bench 120 shown in FIGS. 1-5B). The upper portion 310 may be configured to enclose an upper portion of the optical bench. The housing module 300 (e.g., the lower portion 320) may define a first aperture 330 and a second aperture 340 (e.g., such as aperture 144 shown in FIG. 3). The first aperture 330 may be configured to receive a portion of the battery module. The second aperture 340 may be configured to receive a portion of the adjuster assembly (e.g., such as the second adjuster 134 as shown in FIG. 1). The housing module 300 (e.g., the upper portion 141) may include a front window 350 (e.g., such as front window 146 shown in FIG. 1) and a rear window (e.g., such as rear window 148 shown in FIG. 2).

The housing module 300 may be configured to protect the weapon sight. The housing module 300 may be configured to be installed, adjusted, and/or replaced without affecting an optical path of the weapon sight. For example, the housing module 300 may be a replacement housing module for the weapon sight. Installation of the replacement housing module may be performed without affecting the optical path of the weapon sight.

Figure 9:
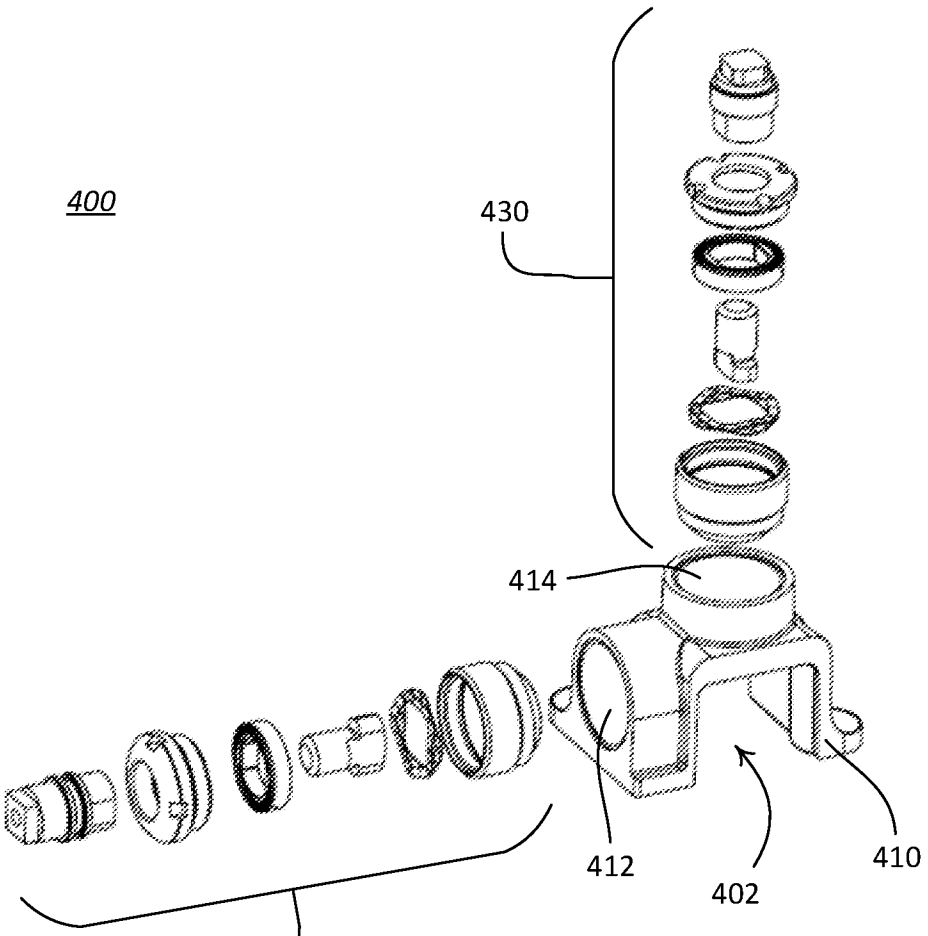
FIG. 9 is an exploded view of the example weapon sight adjuster assembly shown in FIG. 8.
Figure 8:
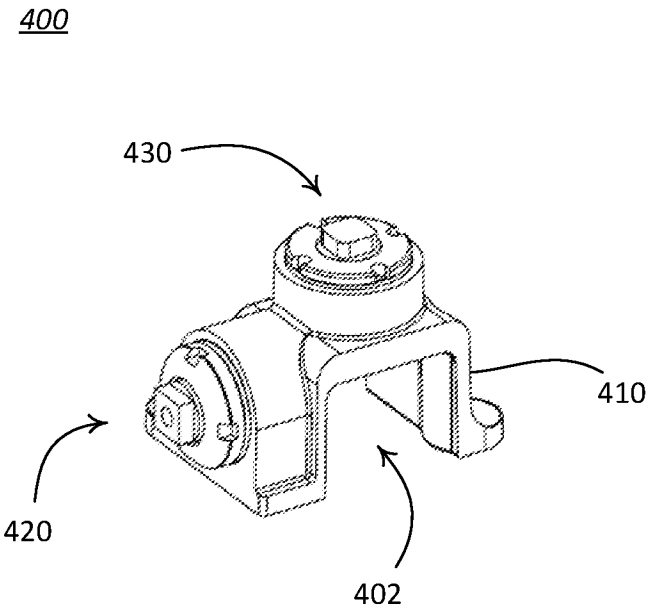
FIG. 8 is a perspective view of an example weapon sight adjuster assembly.

FIGS. 8-9 depict an example adjuster assembly 400 for a weapon sight (e.g., such as weapon sight 100 shown in FIGS. 1-5B). The adjuster assembly 400 may be associated with an adjuster assembly datum. The adjuster assembly datum may define an adjuster assembly reference point, surface, or axis that is used to dimension and/or tolerance the adjuster assembly 400 (e.g., one or more components of the adjuster assembly 400). The adjuster assembly datum may be associated with a third reference system. The third reference system may be a spatial reference system and/or a coordinate reference system used to locate one or more components or features of the adjuster assembly 400. The components and features of the adjuster assembly 400 may be assembled and/or fabricated in relation to the adjuster assembly datum using the third reference system. An origin of the third reference system may be defined by the adjuster assembly datum.

The adjuster assembly 400 may include an adjuster support bridge 410, a first adjuster assembly 420 and a second adjuster assembly 430. The first adjuster assembly 420 may be a windage adjustment assembly configured to horizontally adjust a position of a holographic reticle in a viewing area of the weapon sight. The second adjuster assembly 430 may be an elevation adjustment assembly configured to vertically adjust the position of the holographic reticle in the viewing area of the weapon sight.

The adjuster support bridge 410 may define an orifice 402. For example, the adjuster bridge 410 may span the orifice 402. The orifice 402 may be configured to receive a portion of the weapon sight. For example, the orifice 402 may be configured to receive a portion of an optical bench of the weapon sight (e.g., such as the receptacle 530 of the optical bench 500 shown in FIGS. 10-11). The adjuster support bridge 410 may be configured to receive the first adjuster assembly 420 and the second adjuster assembly 430. For example, the first adjuster assembly 420 and the second adjuster assembly 430 may be configured to be secured within the adjuster support bridge 410. The adjuster support bridge 410 may define a first opening 412 and a second opening 414. The first opening 412 may be configured to receive the first adjuster assembly 420. The second opening 414 may be configured to receive the second adjuster assembly 430.

The first adjuster assembly 420 (e.g., a distal portion) may be configured to abut and apply a force to a portion of the optical bench and thereby adjust a horizontal position of the optical bench. For example, rotation of the first adjuster assembly 420 may adjust a horizontal orientation of the optical bench. Clockwise rotation of the first adjuster assembly 420 may adjust the optical bench in a first horizontal direction. Counter-clockwise rotation of the first adjuster assembly 420 may adjust the optical bench in a second horizontal direction. The horizontal position of the optical bench may be correlated with a horizontal position of the holographic reticle in the viewing area of the weapon sight.

The second adjuster assembly 430 (e.g., a distal portion) may be configured to abut and apply a force to a portion of the optical bench and thereby adjust a vertical position of the optical bench. For example, rotation of the second adjuster assembly 430 may adjust a vertical orientation of the optical bench. Clockwise rotation of the second adjuster assembly 430 may adjust the optical bench in a first vertical direction. Counter-clockwise rotation of the second adjuster assembly 430 may adjust the optical bench in a second vertical direction. The vertical position of the optical bench may be correlated with a vertical position of the holographic reticle in the viewing area of the weapon sight.

Figure 10:
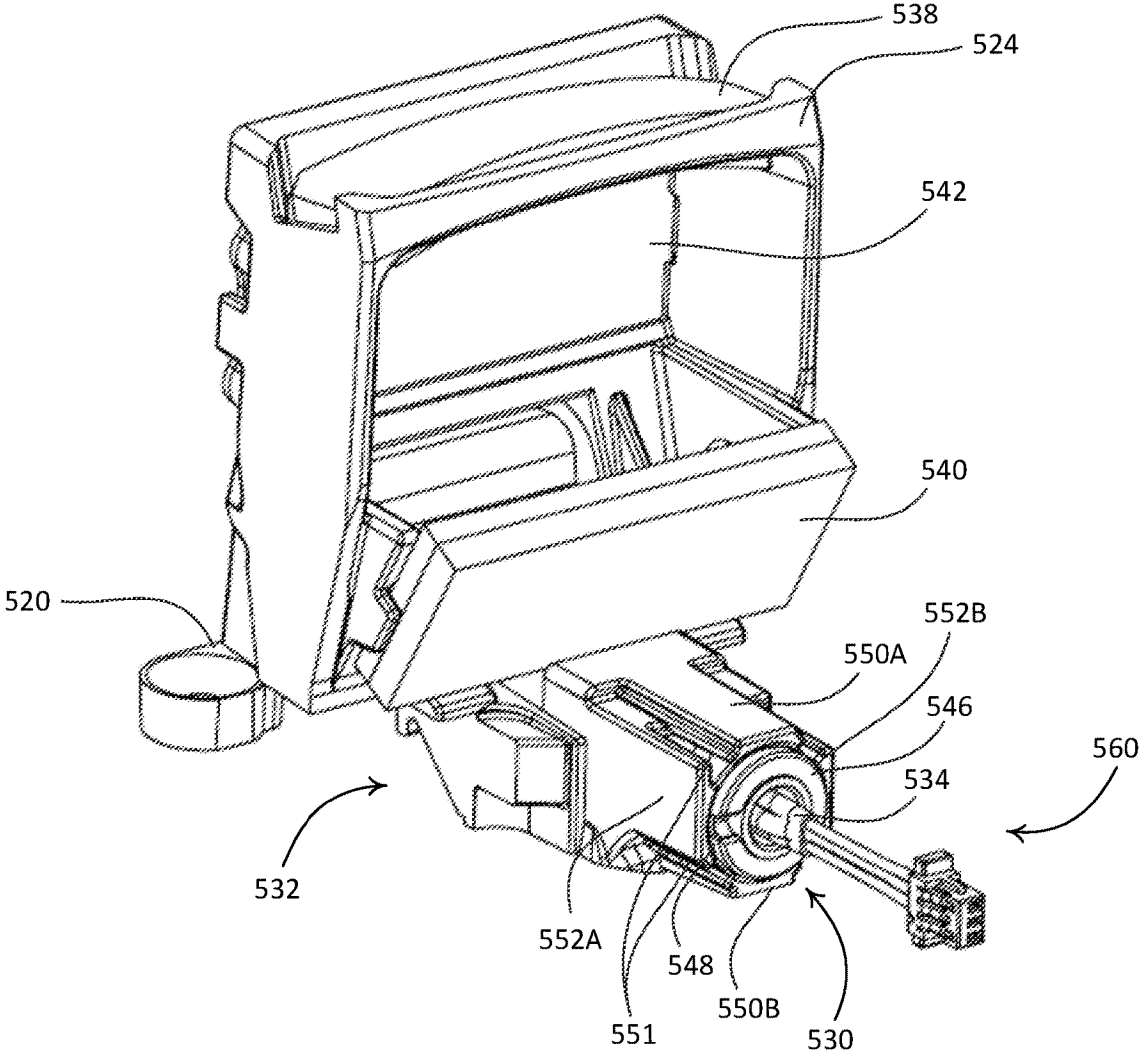
FIG. 10 is a perspective view of an example weapon sight optical bench.
Figure 11:
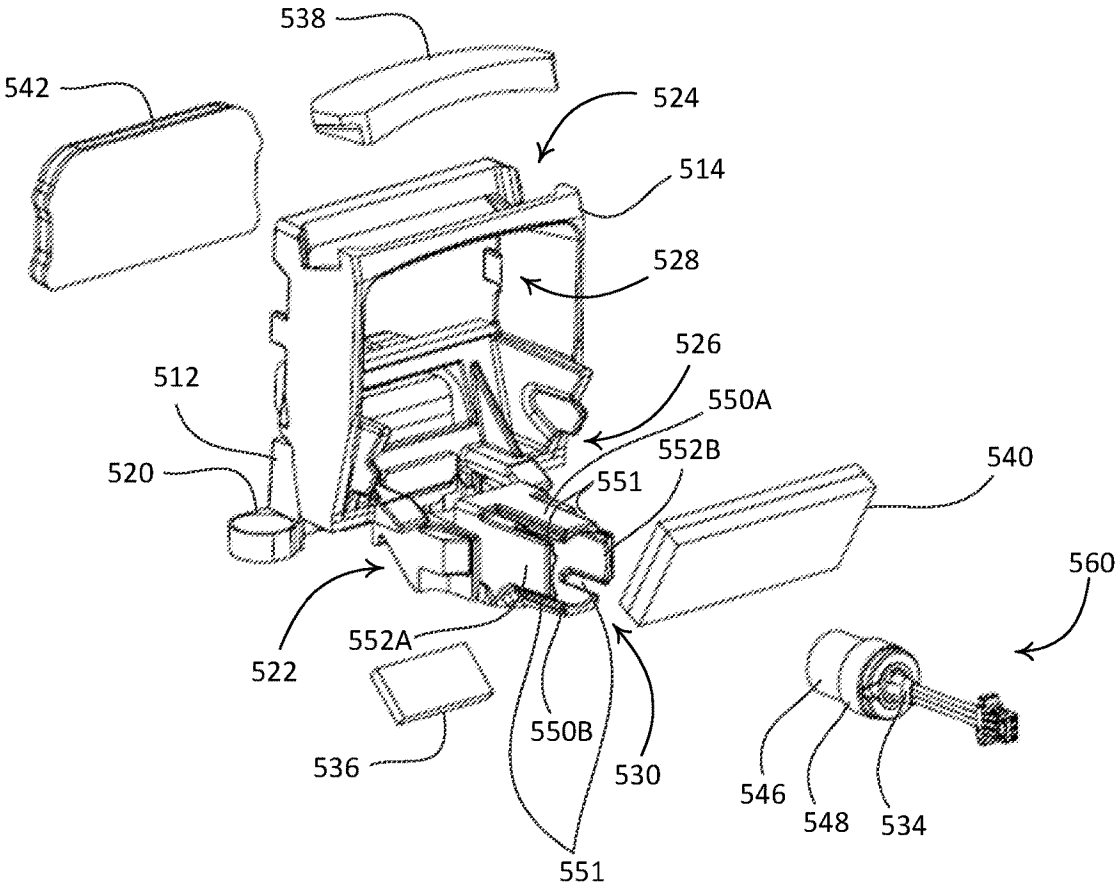
FIG. 11 is a partially exploded view of the example weapon sight optical bench shown in FIG. 10.

FIGS. 10-11 depict an example optical bench 500 for a weapon sight (e.g., such as weapon sight 100 shown in FIGS. 1-5B). The optical bench 500 may be associated with an optical bench datum. The optical bench datum may define an optical bench reference point, surface, or axis that is used to dimension and/or tolerance the optical bench 500 (e.g., one or more components of the optical bench 500). The optical bench datum may be associated with a fourth reference system. The fourth reference system may be a spatial reference system and/or a coordinate reference system used to locate one or more components or features of the optical bench 500. The components and features of the optical bench 500 may be assembled and/or fabricated in relation to the optical bench datum using the fourth reference system. An origin of the fourth reference system may be defined by the optical bench datum.

The optical bench 500 may include an optical bench body 514 and a plurality of optical components. The plurality of optical components may be configured to display a holographic image to a user of the weapon sight. The holographic image may be a reticle. The plurality of optical components may include a laser diode 534, a mirror 536, a collimator 538, a grating 540, and/or a hologram plate 542. The 107 7+9++9+9+9Aaaser diode 534 may be configured to generate visible light which is directed toward and received at the mirror 536. The mirror 536 (e.g., a transfer mirror) may be configured to reflect light received from the laser diode 534 toward the collimator 538. The collimator 538 (e.g., a collimating optic) may be configured to receive reflected light from the mirror 536 and to direct collimated light to the grating 540. The grating 540 (e.g., a diffraction grating) may be configured to receive the collimated light from the collimator 538 and to reflect diffracted light toward the hologram plate 542. The hologram plate 542 may be configured to receive light from the grating 540 and project a hologram image (e.g., such as a holographic reticle) which may be viewed in a viewing area of the weapon sight. The weapon sight may display the hologram image to an operator who looks through the viewing area presented by a rear window of the weapon sight (e.g., such as the rear window 148 shown in FIGS. 2-4). The hologram image may be configured to assist an operator in locating and targeting an object. For example, the hologram image may be a reticle, although other images may be employed.

The optical bench 500 may be a unitary optical component carrier that includes an optical bench body 514 that may serve as a bench or rack to which the optical components are attached. The optical bench body 514 may be integrally formed with a support member 512. The support member 512 may be integrally formed with an optical bench base 520. The optical bench body 514 may comprise a rigid body and may be substantially resistant to changes in relative distances between the optical components. For example, in a scenario wherein forces are applied to a first receptacle 530 by an adjuster assembly (e.g., such as adjuster assembly 130 shown in FIG. 3), the optical bench body 514 may be resistant to distortion and may move without altering relative distances between the optical components (e.g., optical components 534, 536, 538, 540, and 542). Stated differently, the relative distances between the optical components may remain substantially unchanged when a force is applied to the first receptacle 530. The optical bench body 514 may be made from a material that has a relatively low coefficient of thermal expansion. As a result, the relative distance between the optical components may remain substantially the same over a wide spectrum of temperature environments. In an example, optical bench body 514 may be manufactured from titanium.

The optical bench 500 may include a plurality of receptacles 522, 524, 526, 528, 530 configured to receive optical components. Each of the receptacles 522, 524, 526, 528, 530 may include one or more surfaces configured to receive corresponding surfaces of respective optical components. The surface to surface mounting results in precise location of the optical components relative to the optical bench body 514 and to each other. The receptacles 522, 524, 526, 528, 530 may be configured to allow the corresponding optical components to be applied from the exterior of the optical bench body 514. Mounting of the optical components from the exterior may be performed by an automated means such as, for example, by robotic handling. The optical components may be secured in the receptacles 522, 524, 526, 528, 530 via friction between the optical components and the corresponding receptacle and/or by application of an adhesive between the optical components and the corresponding receptacle. For example, receptacle 522 may be configured to receive the mirror 536. The receptacle 524 may be configured to receive the collimator 538. The receptacle 526 may be configured to receive the grating 540. The receptacle 528 may be configured to receive the hologram plate 542. The receptacle 530 may be configured to receive the laser diode assembly 560.

The receptacle 530 may include a first set of opposing side walls 550A, 550B and a second set of opposing side walls 552A, 552B. The first set of opposing side walls 550A, 550B and the second set of opposing side walls 552A, 552B may form a receptacle for receiving a laser diode assembly 560. Openings 551 may be formed between adjacent sidewalls 550, 552 which may allow opposing side walls 550A, 550B to be flexed apart from each other. The external surfaces of the side walls 550A, 550B and the side walls 552A, 552B may be substantially flat or planar and configured to receive forces. For example, the side wall 550A may be a substantially flat or planar external surface and may be contacted by a first projection from the adjuster assembly (e.g., such as the second adjuster 134 shown in FIG. 3). The first projection of the adjuster assembly may apply a force in a vertical direction relative to the optical bench base 520. When the force is applied to the side wall 550A and/or adjusted, a vertical position of a holographic reticle within the weapon sight may be adjusted. The side wall 552A may be a substantially flat or planar external surface and may be contacted by a second projection from the adjuster assembly (e.g., such as the first adjuster 132 shown in FIG. 3). The second projection of the adjuster assembly may apply a force in a horizontal direction relative to the optical bench base 520. When the force is applied to the sidewall 552A and/or adjusted, a horizontal position of the holographic reticle within the weapon sight may be adjusted. Application of the force(s) to the side wall 550A and/or the side wall 552A may adjust the position of the holographic reticle without altering the relative position of the optical components 534, 536, 538, 540, and 542 with respect to one another.

The laser diode assembly 560 may include a laser diode 534, a laser diode shoe 546, and/or a laser diode ring 548. The laser diode 534 may be positioned within the laser diode shoe 546. The laser diode shoe 546 may be formed in a substantially cylindrical shape with an interior surface and an external surface. The interior surface of the laser diode shoe 546 may be sized to receive and form a frictional interference fit with the laser diode 534. The laser diode ring 548 may be formed in a substantially cylindrical shape with an interior surface and an external surface. The interior surface of the laser diode ring 548 may be sized and shaped to form a frictional interference fit with the external surface of the laser diode shoe 546. The laser diode assembly 560 may be configured to be inserted into the first receptacle 530. For example, a force may be applied to the laser diode shoe 546 (e.g., using a tool such as insertion tool) without applying a force to the laser diode 534.

The external surface of the laser diode ring 548 may form a frictional interference fit with internal sides of opposing side walls 550A, 550B, 552A, 552B. The external diameter of the laser diode ring 548 may be larger than the opening formed by the opposing side walls 550A, 550B, 552A, 552B. Accordingly, one or more of the opposing side walls 550A, 550B, 552A, 552B may flex outward to receive the laser diode ring 548.

Figure 12:
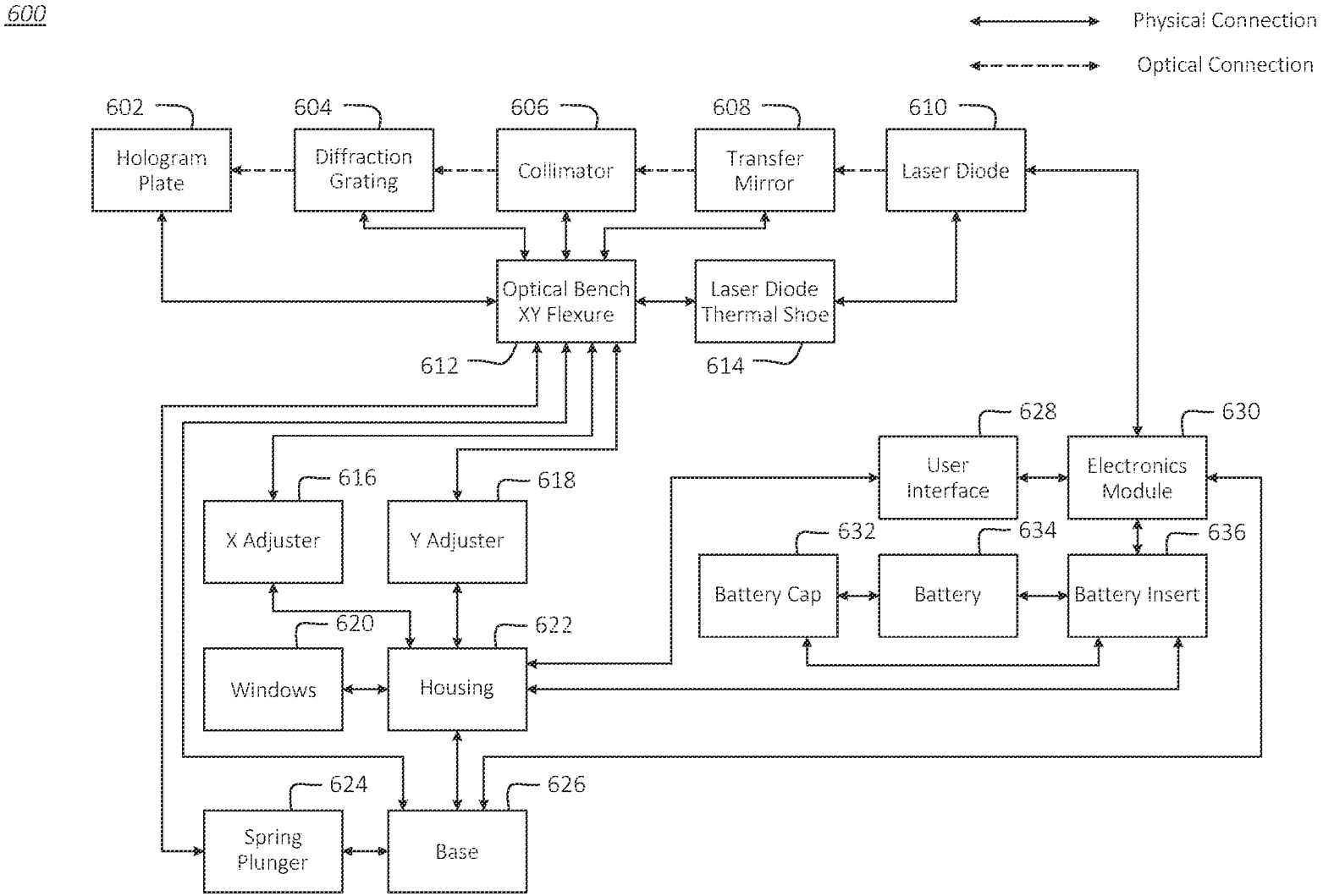
FIG. 12 is a block diagram of an example modular weapon sight showing the physical connections and optical connections.

FIG. 12 is a functional block diagram of an example modular weapon sight 600 (e.g., such as the weapon sight 100 shown in FIGS. 1-5B) showing the physical connections and optical connections between the components of the weapon sight 600. The weapon sight 600 may be configured to minimize the physical connections between the components of the weapon sight 600. A hologram plate 602 may be physically connected to (e.g., only) an optical bench 612. The optical bench 612 may be referred to as an optical chassis herein. A diffraction grating 604 may be physically connected to (e.g., only) the optical bench 612. The hologram plate 602 may be optically connected to (e.g., only) the diffraction grating 604. The diffraction grating 604 may be optically connected to the hologram plate 602 and a collimator 606. The collimator 606 may be physically connected to (e.g., only) the optical bench 612. The collimator 606 may be optically connected to the diffraction grating 604 and a transfer mirror 608. The transfer mirror 608 may be physically connected to (e.g., only) the optical bench 612. The transfer mirror 608 may be optically connected to the collimator 606 and a laser diode 610. The laser diode 610 may be physically connected to a laser diode shoe 614 and an electronics module. The laser diode 610 may be optically connected to the transfer mirror 608. The laser diode shoe 614 may be physically connected to (e.g., only) the optical bench 612.

A horizontal adjuster 616 may be physically connected to the optical bench 612 and a housing 622. A vertical adjuster 618 may be physically connected to the optical bench 612 and the housing 622. One or more windows 620 may be physically connected to (e.g., only) the optical bench 612. A spring plunger 624 may be physically connected to the optical bench 612 and/or a base 626. The housing 622 may be physically connected to the base 626.

The electronics module 630 may be physically connected to the base 626, a user interface 628, and a battery insert 636. The user interface 628 may be physically connected to the housing 622. The battery insert 636 may be physically connected to a battery 634 and the electronics module 630. The battery 634 may be physically connected to the battery insert 636 and a battery cap 632. The battery cap 632 may be physically connected to the battery 634 and the battery insert 636.

The terms used herein should be seen to be terms of description rather than of limitation. It is understood that those of skill in the art with this disclosure may devise alternatives, modifications, or variations of the principles of the invention. It is intended that all such alternatives, modifications, or variations be considered as within the spirit and scope of this invention, as defined by the following claims.

Embodiments may take the form of a tangible computer-usable or computer-readable medium providing program code for use by or in connection with a computer or any instruction execution system. Examples of a computer-usable or computer-readable medium include tangible computer media such as semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. A processor may be configured to execute instructions stored in memory to perform the various functions and/or functional modules described herein.

What is claimed:

1. A weapon sight comprising:

a base that is configured to be releasably secured to a weapon;

an optical bench attached to the base and configured to display a holographic image to a user of the weapon sight; and an adjuster assembly attached to the base and configured to adjust a position of the optical bench relative to the base;

wherein the adjuster assembly comprises:

an adjuster support bridge that is attached to the base;

a first adjuster supported by the adjuster support bridge and configured to adjust a horizontal position of the optical bench; and a second adjuster supported by the adjuster support bridge and configured to adjust a vertical position of the optical bench;

wherein the adjuster support bridge comprises a first leg portion and a second leg portion that are separated from each other to define an orifice sized to receive a receptacle of the optical bench; and wherein the base, the optical bench, and the adjuster assembly are configured as separate modules, such that an optical path of the optical bench remains constant during adjustment or replacement of the base or the adjuster assembly.

2. The weapon sight of claim 1, wherein the optical bench comprises a plurality of optical components configured to display the holographic image to the user of the weapon sight.

3. The weapon sight of claim 2, wherein the plurality of optical components comprises a laser diode, a mirror, a collimating optic, and a holographic grating.

4. The weapon sight of claim 2, wherein a change in position of the adjuster assembly does not alter a relative position of the plurality of optical components with respect to one another.

5. The weapon sight of claim 1, further comprising a housing that encloses the optical bench, wherein the housing includes a front window and a rear window that define a viewing area of the weapon sight.

6. The weapon sight of claim 1, wherein the adjuster assembly comprises an adjuster having a distal portion configured to apply a force to the optical bench to adjust a position of the optical bench and the corresponding holographic image.

7. A weapon sight comprising:

an optical bench having a plurality of optical components configured to display a holographic image to a user of the weapon sight; and an adjuster assembly engaged with a portion of the optical bench and configured to be secured relative to a weapon;

wherein the adjuster assembly is configured to adjust a position of the optical bench relative to the weapon, such that an optical path of the optical bench remains constant during adjustment of the adjuster assembly;

wherein the adjuster assembly comprises:

an adjuster support bridge that is configured to be secured relative to the weapon;

a first adjuster supported by the adjuster support bridge and configured to adjust a horizontal position of the optical bench; and a second adjuster supported by the adjuster support bridge and configured to adjust a vertical position of the optical bench; and wherein the adjuster support bridge comprises a first leg portion and a second leg portion that are separated from each other to define an orifice sized to receive a receptacle of the optical bench.

8. The weapon sight of claim 7, further comprising a base that is configured to be releasably secured to the weapon, wherein the adjuster assembly is attached to the base.

9. The weapon sight of claim 8, wherein the base, the optical bench, and the adjuster assembly are configured as separate modules.

10. The weapon sight of claim 7, wherein the plurality of optical components comprises a laser diode, a mirror, a collimating optic, and a holographic grating.

11. The weapon sight of claim 7, further comprising a housing that encloses the optical bench, wherein the housing includes a front window and a rear window that define a viewing area of the weapon sight that is aligned with the optical path of the optical bench.

12. The weapon sight of claim 7, wherein the adjuster assembly comprises an adjuster having a distal portion configured to apply a force to the optical bench to adjust a position of the optical bench and the corresponding holographic image.

13. The weapon sight of claim 7, wherein the adjuster assembly comprises:

a first adjuster configured to adjust a horizontal position of the optical bench; and a second adjuster configured to adjust a vertical position of the optical bench.

14. The weapon sight of claim 13, wherein the adjuster assembly comprises an adjuster support bridge that supports the first and second adjusters and defines an orifice sized to receive a receptacle of the optical bench.

15. A weapon sight comprising:

a base configured to be releasably secured to a weapon;

an optical bench attached to the base;

an adjuster assembly attached to the base, with the adjuster assembly having:

an adjuster support bridge attached to the base and comprising a first leg portion and a second leg portion that are separated from each other to define an orifice sized to receive a receptacle of the optical bench;

a first adjuster supported by the adjuster support bridge and configured to horizontally adjust a position of a holographic image displayed to a user of the weapon sight; and a second adjuster supported by the adjuster support bridge and configured to vertically adjust the position of the holographic image displayed to the user of the weapon sight; and a housing that encloses the optical bench within the weapon sight;

wherein the base, the optical bench, the adjuster assembly, and the housing are configured as separate modules.

16. The weapon sight of claim 15, wherein the optical bench comprises a plurality of optical elements attached to a unitary optical component carrier, and wherein a relative position of the plurality of optical elements define an optical path of the weapon sight.

17. The weapon sight of claim 16, wherein a change in position of the adjuster assembly does not alter a relative position of the plurality of optical elements with respect to one another.

* * * * *